US010955133B2

(12) United States Patent
Miklos et al.

(10) Patent No.: US 10,955,133 B2
(45) Date of Patent: Mar. 23, 2021

(54) METHOD FOR FLAME STRAIGHTENING AND BURNER ASSEMBLY FOR THIS PURPOSE

(71) Applicant: LINDE AKTIENGESELLSCHAFT, Munich (DE)

(72) Inventors: Ernst Miklos, Kirchheim (DE); Ronald Steusloff, Neukloster (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 69 days.

(21) Appl. No.: 15/939,838

(22) Filed: Mar. 29, 2018

(65) Prior Publication Data

US 2018/0292086 A1 Oct. 11, 2018

(30) Foreign Application Priority Data

Apr. 5, 2017 (DE) ..... 10 2017 003 388.9

(51) Int. Cl.

| | |
|---|---|
| ***F23C 99/00*** | (2006.01) |
| ***F23D 14/32*** | (2006.01) |
| ***F23D 14/38*** | (2006.01) |
| ***B21D 3/00*** | (2006.01) |
| ***B21D 1/06*** | (2006.01) |
| ***F23D 14/46*** | (2006.01) |
| ***F23D 14/84*** | (2006.01) |
| *F23D 14/10* | (2006.01) |

(52) U.S. Cl.

CPC ..... *F23C 99/001* (2013.01); *B21D 1/06* (2013.01); *B21D 3/00* (2013.01); *F23D 14/32* (2013.01); *F23D 14/38* (2013.01); *F23D 14/465* (2013.01); *F23D 14/84* (2013.01); *F23D 14/105* (2013.01)

(58) Field of Classification Search

CPC ..... F23C 99/001; F23D 14/32

See application file for complete search history.

(56) References Cited

U.S. PATENT DOCUMENTS

| | | | | |
|---|---|---|---|---|
| 2014/0065558 A1* | 3/2014 | Colannino | ..... | F23D 14/68 431/6 |
| 2015/0104748 A1* | 4/2015 | Dumas | ..... | F23N 5/082 431/2 |
| 2016/0018812 A1* | 1/2016 | Martin | ..... | B23K 5/00 700/114 |
| 2016/0033125 A1* | 2/2016 | Krichtafovitch | ..... | H02J 7/0052 431/2 |

* cited by examiner

*Primary Examiner* — Steven B McAllister
*Assistant Examiner* — Aaron H Heyamoto
(74) *Attorney, Agent, or Firm* — Millen White Zelano & Branigan, PC; Brion P. Heaney

(57) ABSTRACT

A method for flame straightening is disclosed, wherein acetylene with oxygen is combusted by means of a burner to yield a flame, and the flame is directed onto a workpiece so as to heat the workpiece, wherein an electric field is applied between the burner and the non-melting workpiece which is electrically conductive, or the electric field is applied between the burner and a non-melting electrode arranged on the non-melting workpiece side to reduce NOx emission.

17 Claims, 2 Drawing Sheets

METHOD FOR FLAME STRAIGHTENING AND BURNER ASSEMBLY FOR THIS PURPOSE

CROSS REFERENCE TO RELATED APPLICATIONS

This application claims priority from German patent application DE 10 2017 003 388.9 filed on Apr. 6, 2017.

BACKGROUND OF THE INVENTION

The present invention relates to a method for flame straightening, as well as to a burner assembly for flame straightening, and finally to a use of such a burner assembly.

Flame straightening ("flame straightening") involves a targeted flame heating (English: "direct flame impingement heating") most often of metal structures, in which narrowly limited component areas are heated to a flame straightening temperature. When components are joined together, for example through welding, the heating and cooling processes result in stresses that can end up warping the workpiece. During flame straightening, the workpiece is locally heated in a targeted manner until into the plastic range. Welding-related warpage, distortion, bending or twisting can be quickly straightened with the flame while being gentle on the material. When heating, not just the flame straightening temperature level must be considered, but also the flame setting, so as to meet the material-specific characteristics. In particular, use is made of a hard-burning acetylene-oxygen flame, which is set to neutral, excess oxygen or excess acetylene.

Acetylene-oxygen flames produce high flame temperatures and high flame propagation rates. This makes it possible to achieve a high productivity in applications such as pre- and post-heating while welding, hot forming, coating melting, flame soldering, flame bending, etc. However, high combustion temperatures can also facilitate the emission of nitrogen oxides (NO, $NO_2$; abbreviated NOx).

Acetylene-oxygen combustion has different chemical-physical kinetics than methane-air combustion, for example. $N_2$ is not present in the oxidant in acetylene-oxygen combustion. The energy involved in breaking open the triple bond lies at another order of magnitude for acetylene ($C_2H_2$) (factor of 2-3) than for methane ($CH_4$) dissociation. During $CH_4$ (or $C_3H_8$) combustion with air, the majority of the NOx quantity already forms in the flame, since high temperatures along with constituents N and O are present there. During $C_2H_2$ combustion with $O_2$ (oxygen), NOx can only form in the area of the secondary flame and at the outer edge of the flame, where nitrogen ($N_2$) specifically is drawn into the reaction from the ambient air.

The object of the present invention is to suppress or entirely avoid NOx emissions that arise during flame straightening with an acetylene-oxygen flame.

SUMMARY OF THE INVENTION

The present invention relates to a method for flame straightening, wherein acetylene with oxygen is combusted by means of a burner to produce a flame, and the flame is directed at a workpiece in order to heat it, as well as to a corresponding burner assembly according to the independent claims. Advantageous embodiments may be gleaned from the respective subclaims and following description.

According to the invention, an electric field is applied between the burner and non-melting workpiece, provided it is electrically conductive, so as to reduce any NOx emission. Alternatively, the electric field is applied between the burner and a non-melting electrode arranged on the workpiece side. It was discovered that, given a properly set electric field strength, the NOx emission can be reduced during flame straightening with an acetylene-oxygen flame, in particular in the area of the secondary flame and at the outer edge of the flame. It here makes sense for the shape of the generated electric field to encompass in particular the mentioned areas of the secondary flame and outer edge of the acetylene-oxygen flame. In particular, the shape of the electric field can be influenced by a suitable shape of a non-melting electrode arranged on the workpiece side.

The electric field generated between the burner and the electrically conductive surface of a non-melting workpiece heated by flame straightening changes the combustion kinematics and chemical reaction dynamics in favor of NOx reduction. This is caused by ion separation in the electric field, as well as by the effects of collisions between the corresponding ionized particles. The electrically conductive workpiece can be a metallic workpiece or a nonmetallic workpiece, for example which is coated with an electrically conductive material. In non-electrically conductive workpieces, a non-melting electrode can be arranged on the workpiece side. The electrode is here preferably arranged in the area of the flame, i.e., on the flame side as viewed from the workpiece. A specially shaped, for example annular, electrode can here concentrate the electric field onto the aforementioned areas (secondary flame and outer flame edge), in which NOx formation is facilitated. In another variation, the electrode can also be arranged "underneath" the non-conductive workpiece, i.e., on the side facing away from the flame as viewed from the workpiece. Even if the workpiece is electrically conductive, it may be advantageous to use an electrode arranged on the workpiece side, e.g., when applying a direct voltage to the workpiece is problematic. In this case, the additional electrode is arranged in the area between the burner and workpiece, i.e., in the area of the flame.

The method can also be used for electrically conductive workpieces coated with electrically non-conductive materials. In these cases, the electric field can be applied between the burner and the substrate, i.e., the actual workpiece, wherein the electric field can overcome the dielectric barrier.

The electric field can be a direct voltage or alternating voltage field. It was demonstrated that direct voltage fields are more favorable for the mentioned NOx reduction effect. By contrast, alternating voltage fields offer a higher flexibility in terms of influencing the flame properties on the one hand and NOx reduction on the other. It is advantageous that the polarity of the electric field be negative on the burner side. Given an alternating voltage field, the latter can be set in such a way that the polarity is predominantly negative on the burner side, so that the selected positive phases can be shorter than the negative ones.

The electric field can best be generated by means of at least one electric line to the burner and/or at least one electric line to the electrode or to the electrically conductive workpiece. However, the electric field can also be generated by means of at least one battery arranged in or on the burner and at least one electric line to the electrode or to the electrically conductive workpiece. The at least one battery can be arranged at a suitable location of the burner (nozzle, shaft, mount or feed).

Because of the ions present in the flame, the applied electric field leads to a current flow, wherein this current between the burner and the electrode on the workpiece side or the burner and the workpiece is detected or measured, and can be used as a safety note as to whether a flame is present. This current is interrupted if the flame is extinguished or does not ignite. Known from US 2016/0018812 A1 is a similar current monitor for flame cutting. In flame cutting, the metallic workpiece is melted by the flame instead. Additional cutting oxygen supplied there reacts exothermally, and enters into a combustion reaction with the molten metal. In the mentioned publication, significantly less current by comparison to the present invention is used only for measuring purposes. For example, this includes checking whether a flame is burning or not.

The invention further relates to a burner assembly for flame straightening comprising at least one burner with at least one oxygen supply and at least one acetylene supply, and with means for directing a flame generated by the burner onto a workpiece. At least one voltage source is here provided, and set up in such a way that an electric field is applied between the burner and the non-melting workpiece, provided it is electrically conductive, or a non-melting electrode arranged on the workpiece side, so as to reduce NOx emission. The electrode arranged on the workpiece side can here be a separate electrode independent of the burner or one that is mechanically joined with the actual burner.

Reference is made to the above statements regarding the method according to the invention for further embodiments and advantages of this aspect of the invention. The statements made there apply in equal measure to the burner assembly according to the invention.

Finally, the invention relates to the use of the mentioned burner assembly for reducing NOx emission during flame straightening with an acetylene-oxygen flame.

Additional advantages and embodiments of the invention may be gleaned from the description and attached drawing.

Needless to say, the features mentioned above and yet to be explained below can be used not just in the respectively indicated combination, but also in other combinations or in isolation, without departing from the framework of the present invention.

The invention is schematically illustrated in the drawing based on exemplary embodiments, and will be described below with reference to the drawing.

DETAILED DESCRIPTION OF THE INVENTION

Figure 1:
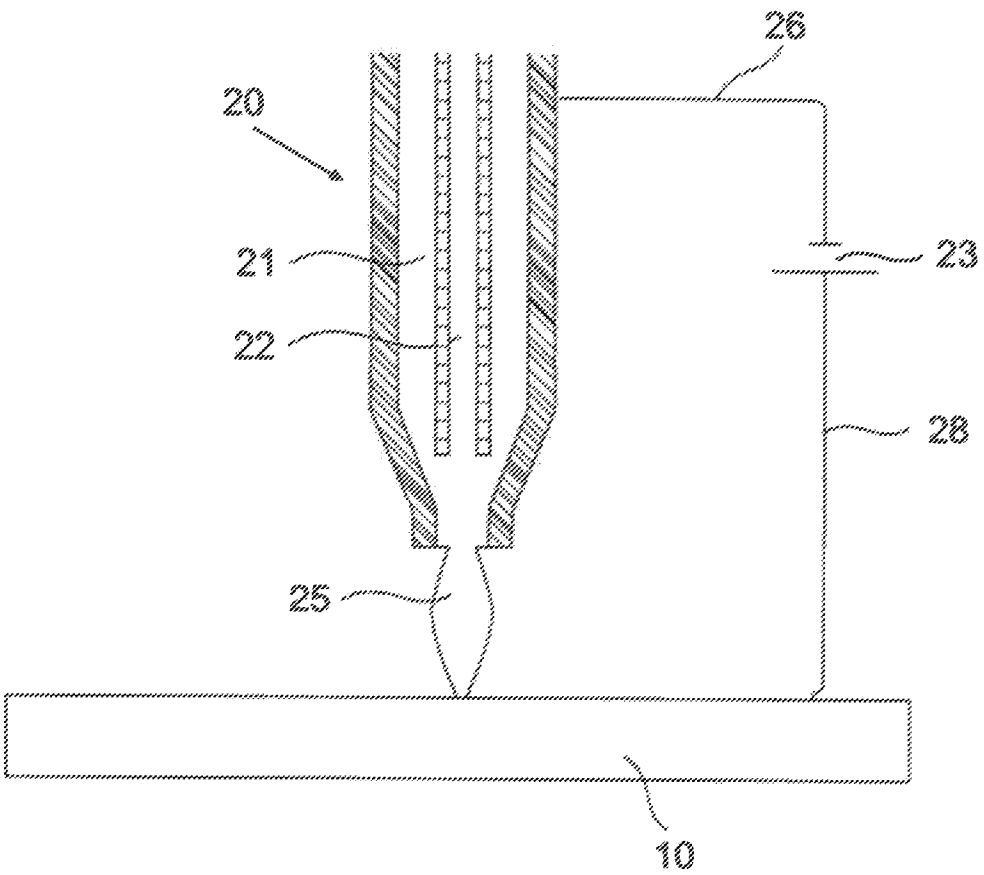
FIG. 1 schematically depicts a first embodiment of a burner assembly for flame straightening.

FIG. 1 presents a schematic view of a first embodiment of a burner assembly for flame straightening with a burner 20 having an oxygen supply 22 and an acetylene supply 21. The means for directing the flame 25 generated by the burner 20 onto a workpiece are here not separately shown. Such an acetylene burner is itself known from prior art.

In order to reduce NOx emissions in the area of the secondary flame in the edge area of the flame 25, an electric field is generated between the burner 20 and the non-melting workpiece 10, which in this exemplary embodiment is electrically conductive or at least coated with an electrically conductive layer. A voltage source 23 is provided to this end, whose first pole is connected with the burner 20 by a line 26, and whose second pole is connected with the workpiece 10 by a line 28. NOx emissions can be greatly reduced by setting a suitable field strength of the electric field by setting a voltage on the voltage source 23. In specific tasks with heat- or surface-sensitive components, an operation with pulsed current or targeted alternating current portions can be advantageous.

Figure 2:
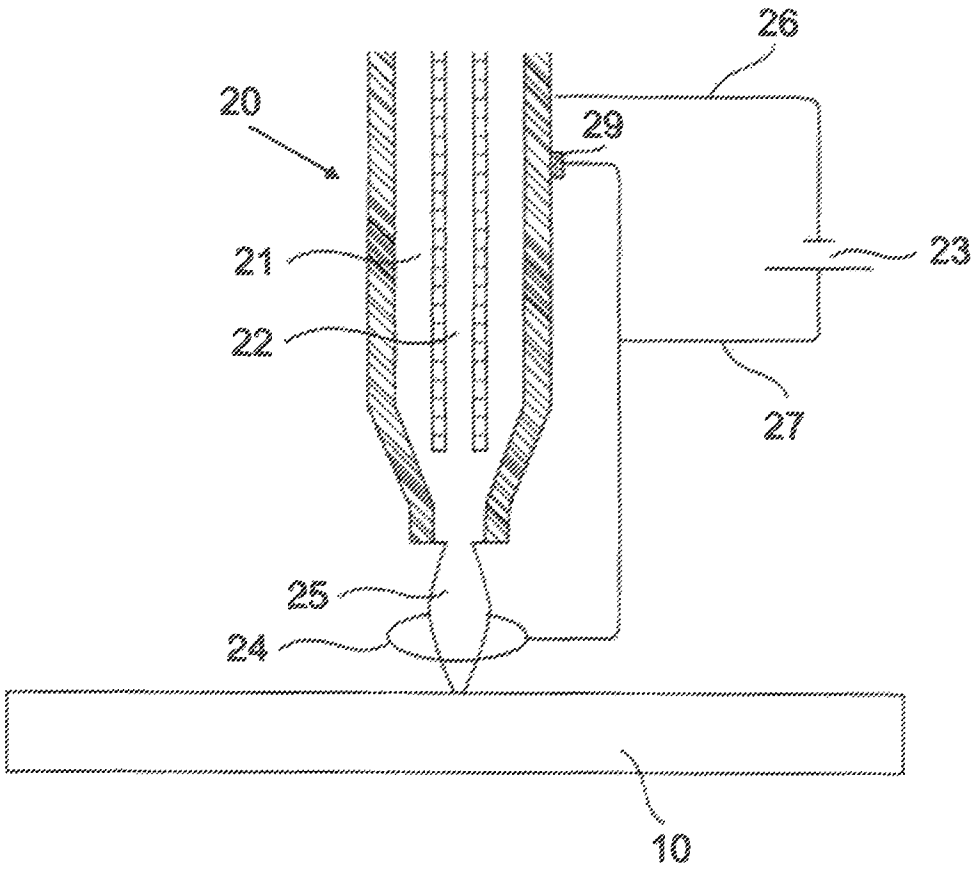
FIG. 2 schematically depicts a second embodiment of a burner assembly for flame straightening.

FIG. 2 shows a second embodiment of a burner assembly for flame straightening, once again with a burner 20 and an oxygen supply 22 and an acetylene supply 21, and with means not depicted for directing a flame 25 generated by the burner 20 onto a workpiece 10. In the exemplary embodiment according to FIG. 2, this workpiece is not electrically conductive, or applying a direct voltage to the workpiece 10 is problematic. In this case, the electric field is applied between the burner 20 and a non-melting electrode 24 arranged on the workpiece side. The electrode 24 is thus arranged between the burner 20 and workpiece 10 in the area of the flame 25. An annular electrode 24 is especially expedient for determining the areas of elevated NOx formation with the generated electric field, and there reducing the NOx emission.

A voltage source is once again provided for generating the electric field, which is connected with the burner 20 by a first line 26, and with the electrode 24 by a second line 27. In this exemplary embodiment, the electrode 24 is mechanically joined with the burner 20, wherein the connection is established via an insulation section 29.

In the depicted embodiments according to FIGS. 1 and 2, the voltage can also be supplied via a battery arranged in or on the burner 20, whose poles are correspondingly joined with the burner housing and the electrode 24 or workpiece 10.

What we claim is:

1. A method for flame straightening, said method comprising:

combusting acetylene with oxygen by means of a burner to yield a flame, directing the flame onto a non-melting workpiece so as to subject the workpiece to flame straightening wherein the workpiece is locally heated in a targeted manner into the plastic range to straighten warpage, distortion, bending and/or twisting, and applying an electric field between the burner and the non-melting workpiece, wherein the non-melting workpiece is electrically conductive, to reduce NOx emission, or applying an electric field between the burner and a non-melting electrode arranged on the non-melting workpiece side to reduce NOx emission.

2. The method according to claim 1, wherein a direct voltage field is used as the electric field.

3. The method according to claim 2, wherein a polarity on the burner side is negative.

4. The method according to claim 1, wherein an alternating voltage field is used as the electric field.

5. The method according to claim 4, wherein, on the burner side, positive phases of the alternating current are shorter than the negative phases.

6. The method according to claim 1, wherein the electric field is generated by means comprising at least one electric line to the burner.

7. The method according to claim 1, wherein the electric field is generated by at least one battery arranged in or on the burner, and at least one electric line to the electrode or to the electrically conductive workpiece.

8. The method according to claim 1, wherein said method comprises applying an electric field between the burner and the non-melting workpiece, wherein the non-melting workpiece is electrically conductive.

9. The method according to claim 8, wherein the electric field is generated by (a) at least one electric line to the burner and (b) at least one electric line to the electrically conductive workpiece.

10. The method according to claim 1, wherein said method comprises applying an electric field between the burner and a non-melting electrode arranged on the non-melting workpiece side.

11. The method according to claim 10, wherein the electrode is arranged between the burner and the workpiece and the electrode has an annular shape.

12. The method according to claim 11, wherein the electric field is generated by (a) at least one electric line to the burner and (b) at least one electric line to the electrode.

13. The method according to claim 10, wherein the electric field is generated by (a) at least one electric line to the burner and (b) at least one electric line to the electrode.

14. The method according to claim 1, wherein the electric field is generated by means comprising at least one electric line to the electrode or to the electrically conductive workpiece.

15. The method according to claim 1, wherein the electric field is generated by (a) at least one electric line to the burner and (b) at least one electric line to the electrically conductive workpiece.

16. The method according to claim 1, wherein the electric field is generated by (a) at least one electric line to the burner and (b) at least one electric line to the electrode.

17. The method according to claim 1, wherein a current is measured between the burner and the electrode on the workpiece side or between the burner and the workpiece and using the measured current to determine whether a flame is present.

* * * * *